US008727341B2

(12) United States Patent
De Ambrogio et al.

(10) Patent No.: US 8,727,341 B2
(45) Date of Patent: May 20, 2014

(54) FEEDING APPARATUS FOR FLAT ITEMS PROCESSED IN A MAIL SORTING MACHINE WITH PULLEYS LOCATED UNDER TRANSPORT DECK

(75) Inventors: Attilio De Ambrogio, Cigliano (IT); Daniele Piana, Quagliuzzo (IT)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/473,146

(22) Filed: May 16, 2012

(65) Prior Publication Data

US 2012/0292845 A1 Nov. 22, 2012

(30) Foreign Application Priority Data

May 17, 2011 (EP) ..... 11305590

(51) Int. Cl.
*B65H 1/02* (2006.01)

(52) U.S. Cl.
CPC ..... *B65H 1/025* (2013.01)
USPC ..... 271/150; 271/31.1; 271/10.06; 271/34

(58) Field of Classification Search
USPC ..... 271/3.12, 31.1, 10.06, 34, 150
See application file for complete search history.

(56) References Cited

U.S. PATENT DOCUMENTS 3,966,193 A * 6/1976 Storace et al. ..... 271/150
4,509,735 A * 4/1985 Kosner ..... 271/150
4,595,188 A * 6/1986 Wiley et al. ..... 271/31.1
5,244,199 A * 9/1993 Wood ..... 271/31.1
5,292,114 A * 3/1994 McConnell ..... 271/150
5,494,276 A * 2/1996 Faber et al. ..... 271/150
2009/0283963 A1* 11/2009 Fee et al. ..... 271/270

FOREIGN PATENT DOCUMENTS

EP 1 531 137 A1 5/2005
EP 2 119 651 A2 11/2009
GB 2 366 559 A 3/2002
WO 95/18761 A1 7/1995

* cited by examiner

*Primary Examiner* — Gerald McClain
(74) *Attorney, Agent, or Firm* — Sughrue Mion, PLLC

(57) ABSTRACT

Flat item feeding apparatus (10) having a delivering section (12) for receiving a large batch of flat items on a transport surface (24, 26*a*, 26*b*) and a singulating section (14) for extracting these items one by one and transferring them downstream. The delivering section includes a transport device (22) for conveying the stacked on edge flat items towards the singulating section, a pushing device (30) for jogging the stacked on edge flat items during the conveying. The transport device has an endless belt (26*a*, 26*b*) protruding a transport deck (24) within a conveying zone B of length d of the delivering section and located a distance d2 from a downstream pulley (29*a*, 29*b*) and a distance d1 from an upstream pulley (27*a*, 27*b*), the distances d1 and d2 respectively defining determined conveying zone A, C in which the at least one endless belt remains below the transport deck.

11 Claims, 5 Drawing Sheets

FEEDING APPARATUS FOR FLAT ITEMS PROCESSED IN A MAIL SORTING MACHINE WITH PULLEYS LOCATED UNDER TRANSPORT DECK

FIELD OF THE INVENTION

The present invention relates generally to systems for handling flat items such as mail or other objects. It is directed more particularly to an improved apparatus and method for feeding flat items stacked on edge by automatically controlling their transport and their presentation to a singulating head of a sorting machine. The items are further processed and finally sorted into individual sort pockets located at the exit of the machine.

BACKGROUND OF THE INVENTION

For a long time now, various feeders exist in document processing systems for delivering documents such as sheets, letters, postcards, checks into these systems for further processing. These feeders generally include a delivery portion and a destacking or singulating portion. The flat items are typically placed onto the delivery portion and delivered to the singulating portion for further processing in a sorting section. Typically operators manually load the items taken from storage boxes, trays, tubs, carts or hampers into the delivery portion at the beginning of the operational cycle. They usually go on loading the items on the fly while the system is running. The items are picked off the stack by a singulating module which feeds a reading module with them one at a time. The optical character or bar code reader reads some indicia printed on the item (e.g. zip code) and generates a signal representative thereof. A computer then processes this signal for directing and diverting this individual item to a designated sort pocket in the stacking section of the system.

U.S. Pat. No. 4,595,188 relates to a speed control system for an envelope feeding mechanism used to feed envelopes to a pickoff device in a high speed mail sorting machine. The feeding mechanism includes a pair of toothed belts which convey the envelopes along an inclined surface. The side edges of the envelopes are received by a third toothed belt which is driven at an elevated position along a side panel. The belts are driven by a multiple speed electric motor controlled by electronic circuitry which automatically decrements or increments the motor speed if the envelopes are bunched together too tightly or too loosely. If the speed is decremented and the envelopes are still tightly bunched, the drive motor is stopped by a shutoff circuit which operates independently of the speed control circuit.

U.S. Pat. No. 6,318,717 is directed to a singulator for feeding documents one at a time onto the transport of a processing machine. The singulator includes a pick-off means and a stripper means for preventing multi-feeds of documents. The stripper means is comprised of two independent stripper assemblies which are mounted one above the other. Each assembly is comprised of an arm which is rotatably mounted to the machine at one end and which has a means at the other end for engaging any multi-fed documents. Each stripper assembly has basically the same structure except the arm of one stripper assembly is shorter than the arm of the other assembly whereby the assemblies contact a multi-fed document at different points.

U.S. Pat. No. 6,511,062 concerns an apparatus and method for controlling the presentation of articles to the singulation head of a system for singulating a stack of edge-mounted articles, for example mixed mail, which mechanism senses the instantaneous pressure at which the lead article of the stack is pressed against the singulation head. A feedback control may be provided responsive to a difference between detected instantaneous pressure and a desired target pressure for controlling at least one drive member in a manner so as to reduce such difference. Where there is a pick window of instantaneous pressure at which singulation can be effectively performed, a control may also be provided to inhibit operation of the singulation head when the instantaneous pressure is outside the pick window. Two vertically spaced pressure sensors may be provided on the singulation head to detect the angle at which the lead article is presented to the head and controls may be provided for the drive mechanism(s) to reduce the difference between the instantaneous angle detected and an optimum angle for singulation and/or to inhibit operation of the singulation head when the instantaneous angle is outside of a range where singulation may be effectively performed. The sensor preferably includes a lever extending from the surface of the singulation head which is moved by a distance dependant on the pressure applied thereto. A servo motor may be connected to the lever to apply a bias pressure thereto which bias pressure is determined by a control signal applied to the motor. The sensor may also include a position encoder generating an output indicative of lever position.

U.S. Pat. No. 7,195,236 discloses automated induction systems and methods for mail and/or other objects. In some embodiments, a system for automated loading of a side-by-side stack of thin objects to a feeder is provided. The system can include, e.g.: a) a transporter having a transport surface upon which a side-by-side stack of thin objects can be conveyed; b) a carrier, configured to carry a side-by-side stack of thin objects, over the transport surface; c) a pusher over the transport surface; d) the pusher and the carrier being movable relative to one another between a first position in which the pusher is inside the carrier behind a side-by-side stack of thin objects on the carrier and a second position in which the pusher is laterally displaced from the carrier, such that the side-by-side stack of thin objects on the carrier is laterally slid off of the carrier by the pusher.

While these types of feeders generally work rather well, those skilled in the art will admit they can still experience significant multi-feed issues in sorting large batches of flat items or mixed flat articles with a size and/or thickness that can significantly vary within the batch. The above prior art documents propose good solutions which are however sophisticated, e.g. involving speed control, pressure control or orientation angle control. Since it highly matters to avoid as much as possible a decrease in throughput, an increase in multi-feeds, an increase in damage, jamming and/or other problems, any improvement in the reduction of multi-feeds of flat items is sought after.

Accordingly, a need exists for a feeding apparatus that can overcome, among other things, the above and/or other issues with existing systems, in a manner as simple and efficient as possible.

SUMMARY OF THE INVENTION

The present invention provides a feeding apparatus for flat items that is particularly applicable to a mail sorting machine. Illustrative functions performed by such sorting machine include, feeding flat items, singulating flat items, transporting flat items through at least a portion of the machine, scanning flat items, printing on flat items, diverting, guiding and sorting flat items according to scanned information.

In accordance with the invention, the flat item feeding apparatus presents:

a delivering section for receiving a large batch of flat items stacked on edge on a transport surface;

a singulating section for extracting these items one by one and transferring them downstream;

said delivering section comprising:

a transport device for conveying said stacked on edge flat items towards said singulating section, a pushing device supported above said transport surface for jogging said stacked on edge flat items during said conveying, wherein said transport device further comprises:

at least one endless belt protruding a transport deck within a determined conveying zone B of length d of said delivering section and located at a determined distance d2 from a downstream pulley and at a distance d1 from an upstream pulley, the distances d1 and d2 respectively defining determined conveying zone A, C in which said at least one endless belt remains below said transport deck, the apparatus being characterized in that a supporting plate is disposed under the determined conveying zone B and in that the upstream pulley and the downstream pulley are both located under said transport deck at two different vertical levels for tensioning and maintaining said at least one endless belt against the supporting plate.

With this particular structure, said delivering section or transport surface comprises at least two determined conveying zones defining at least two conveying phases respectively performed essentially with transporting and pushing means. Indeed, this particular arrangement in the delivering section allows to simply solve current problems originating from two known factors, i.e. the pressure at which the batch of items is pressed against the singulating mechanism, and the angle of the batch relative to this mechanism. This pressure in the invention is optimized at the end of the delivery cycle when the flat items do not rest on the at least one belt any more. With both a high kinetic friction between the singulating belts and the flat item to be singulated, and a better distributed pressure and the lack of friction between the flat items and the conveying belts, the influence of the angle of presentation becomes less critical. The flat items of the large batch should only be stacked virtually vertically for assuring a successful singulation.

According to another feature, d equals at least d1+d2 and d1 is around 10 cm and d2 is around 25 cm.

Advantageously, at least one endless belt is a toothed belt in each notch of which can fit the thickest flat item.

Preferably, said singulating section comprises a forwardly-driven spring-loaded series of transverse endless belts which cooperate with a smaller series of endless belts, the cyclic position of which is changed every n flat items, e.g. 1 cm move every 20 articles, by a motor for limiting belt wear.

In one embodiment, a plurality of sensors is associated with said forwardly-driven spring-loaded series of transverse endless belts for detecting both the presence and the right presentation position of the flat item to be singulated. Said pushing device is removably mounted on said transport device which can drive it over the entire length of said large batch of flat items.

Advantageously, said pushing device is a paddle that can slide on a supporting shaft of the delivering section around which it can also pivot via a handle and a rotating ring while being driven by the at least one endless belt via at least one lug. the at least one lug of the paddle is received in the notch formed between two teeth of the at least one endless belt that drives the paddle, and presents a variable height for maintaining the coupling to said at least one belt over the entire thickness of said batch of envelopes.

Preferably, this large batch of flat items is held straight under a variable pressure between said paddle and said forwardly-driven spring-loaded series of transverse endless belts of the singulating section.

The foregoing in other objects, features and advantages of the invention will be apparent from the following more specific description of a preferred embodiment of the invention as illustrated in the accompanying drawings.

BRIEF DESCRIPTION OF THE DRAWINGS

The actual construction, operation and advantages of the present invention will be better understood by referring to the following drawings in which like numerals identify like parts.

DETAILED DESCRIPTION OF THE PREFERRED EMBODIMENT

Figure 1:
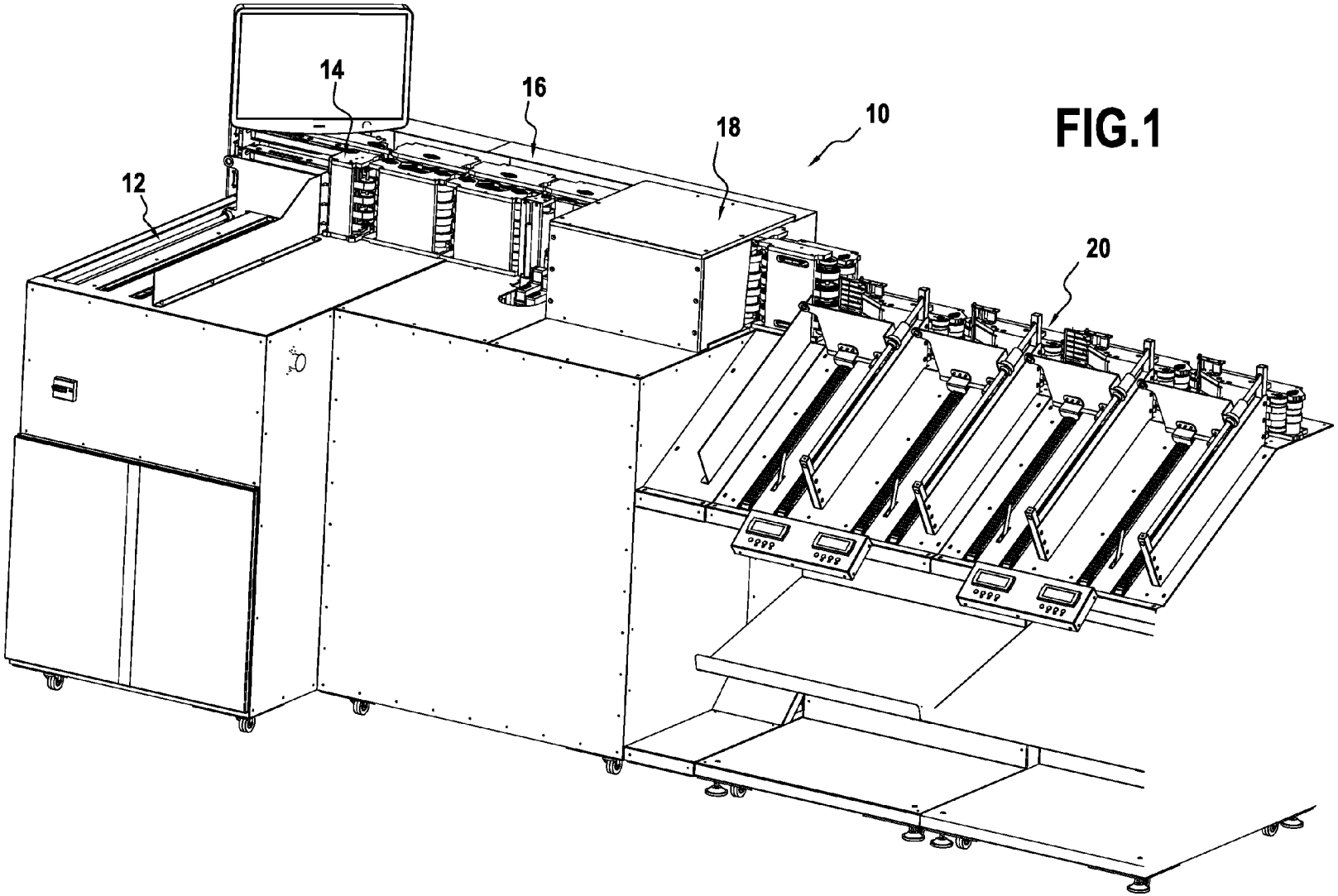
FIG. 1 is a perspective view of a mail sorting machine incorporating the feeding apparatus of the present invention.

Referring now to the drawings in more detail and first to FIG. 1, a mail sorting machine is generally designated by reference numeral 10. Its main components are:

a delivering section 12 which receives flat items such as mail pieces like stuffed envelopes that are to be sorted;

a singulating section 14 at which the individual items are separated one at a time from the stack or batch of envelopes loaded on the delivering section;

a printing section 16 at which some sorting code or information is printed on each envelope;

a scanning section 18 at which the zip code and/or other sorting information imprinted on each envelope is scanned;

a sorting section 20 towards which the envelopes are transported, diverted, guided and stored in designated sort pockets; and a transport and imaging computer (not shown) for controlling the mail sorting machine.

Figure 2:
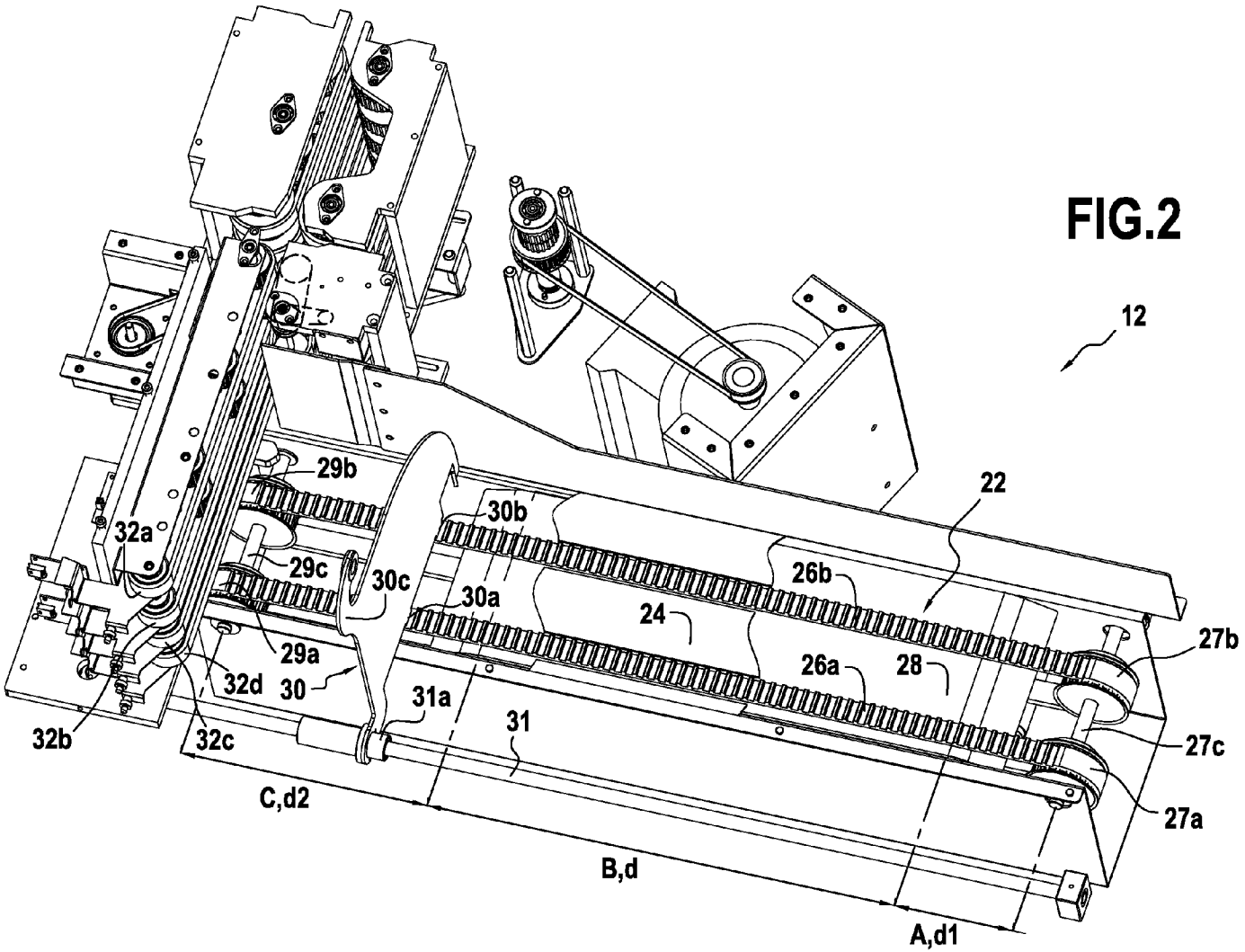
FIG. 2 is a perspective view of the feeding apparatus corresponding to the mail sorting machine of FIG. 1.
Figure 3:
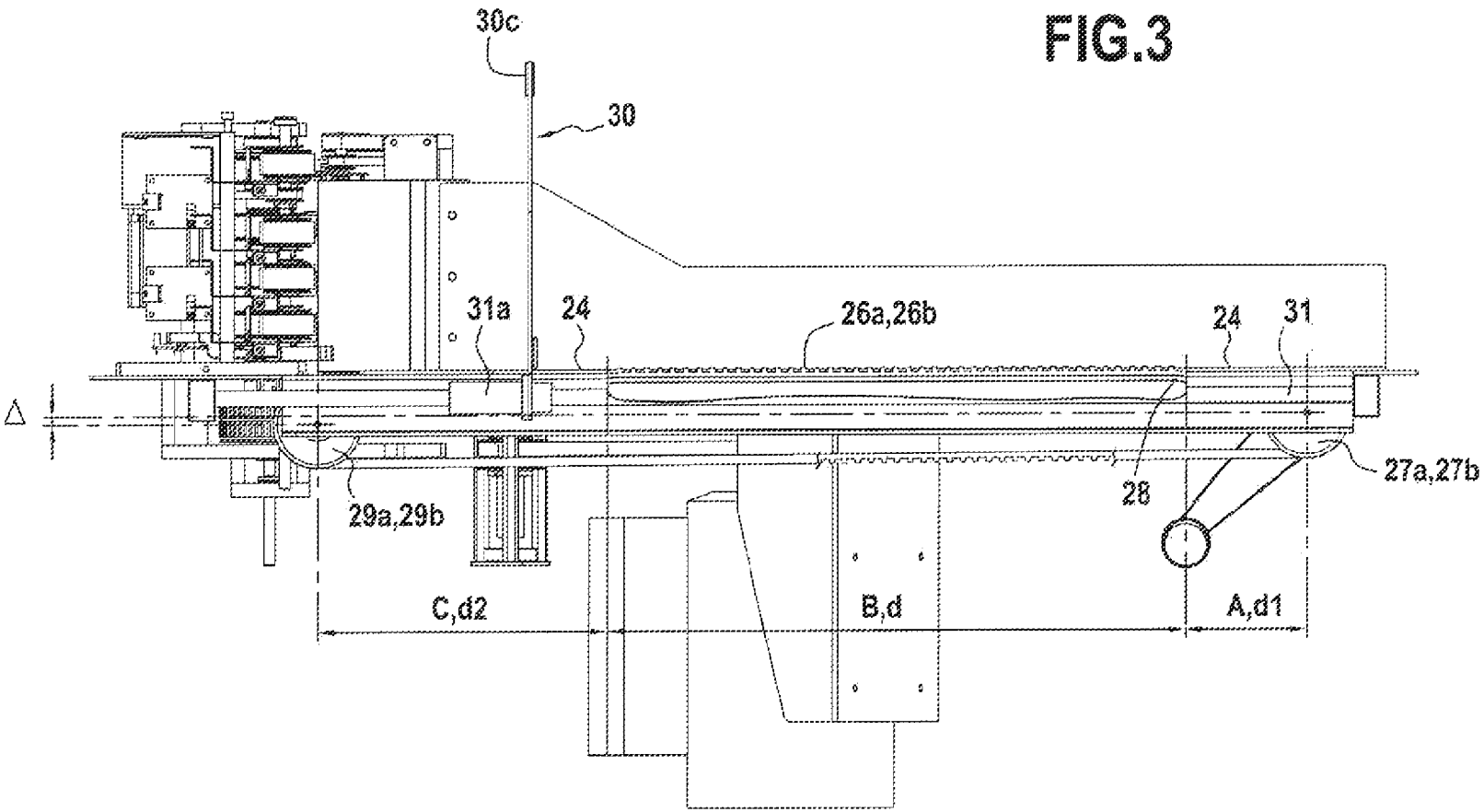
FIG. 3 is a front elevation view of the feeding apparatus represented on FIG. 2.

FIGS. 2 and 3 illustrate in more details delivering and singulating sections forming the feeding apparatus of the mail sorting machine 10. The delivering section 12 comprises a transport device 22 having a transport surface upon which stacked on edge envelopes can be conveyed. The batch of envelopes is moved forward by a conveyor comprising a transport deck 24 with two longitudinal openings for receiving two endless toothed belts 26*a*, 26*b*. The transport surface of the transport device 22 includes this transport deck 24 defining first and third conveying zones A, C, and a first part of the toothed belts 26*a*, 26*b* that actively drives the envelopes resting on their protruding teeth; this first part which defines the second conveying zone B, rests on a supporting plate 28 of the delivering section 12.

These toothed belts run around two pairs of pulleys 27*a*, 27*b*, 29*a*, 29*b* located under the transport deck 24 and carried respectively by shafts 27*c*, 29*c*. Both upstream pulleys 27*a*, 27*b* are motorized and the two series of pulleys 27*a*, 27*b*, 29*a*, 29*b* are positioned at two different vertical levels vis-à-vis the transport deck.

The upstream driving pulleys 27*a*, 27*b* tension the toothed belts 26*a*, 26*b* from below before these latter reach the level of the supporting plate 28 over the first operating zone A. The downstream driven pulleys 29*a*, 29*b* also tension the toothed belts 26*a*, 26*b* from below and force them to leave the supporting plate 28 by going down under the transport deck 24 over the third operating zone C. The supporting plate corresponding to the second operating zone B and of length d is positioned at a distance d1 from the upstream pulleys and at a distance d2 from the downstream pulleys. The length d equals at least d1+d2, i.e. this supporting plate spreads over at least half the thickness of the batch. The distance d1 is generally smaller than d2, e.g. d1 equals about 10 cm and d2 reaches around 25 cm.

A pushing device such as a paddle 30 is removably mounted on said transport device 22. It can slide on a supporting shaft 31 of the delivering section around which it can also pivot via its handle 30*c* and a rotating ring 31*a* mounted on this shaft 31. Projecting parts or lugs 30*a*, 30*b* of the paddle 30 are received in respective notches formed between two teeth of the toothed belts 26*a*, 26*b* that drive the paddle over the entire thickness of said batch of envelopes. Lugs 30*a*, 30*b* have different heights to keep the paddle engaged with either toothed belt 26*a* or toothed belt 26*b*. Shorter lug 30*a* cooperates with toothed belt 26*a* in conveying zones A and B whereas longer lug 26*b* cooperates with toothed belt 26*b* in third zone C where the toothed belts are under the transport deck 24.

The singulating section comprises a forwardly-driven spring-loaded series of transverse endless belts 32*a*-32*d*. These endless belts are superimposed from the transport deck 24 to a sufficient height for receiving envelopes on edge, typically 16 cm corresponding to C5 format.

Figure 4:
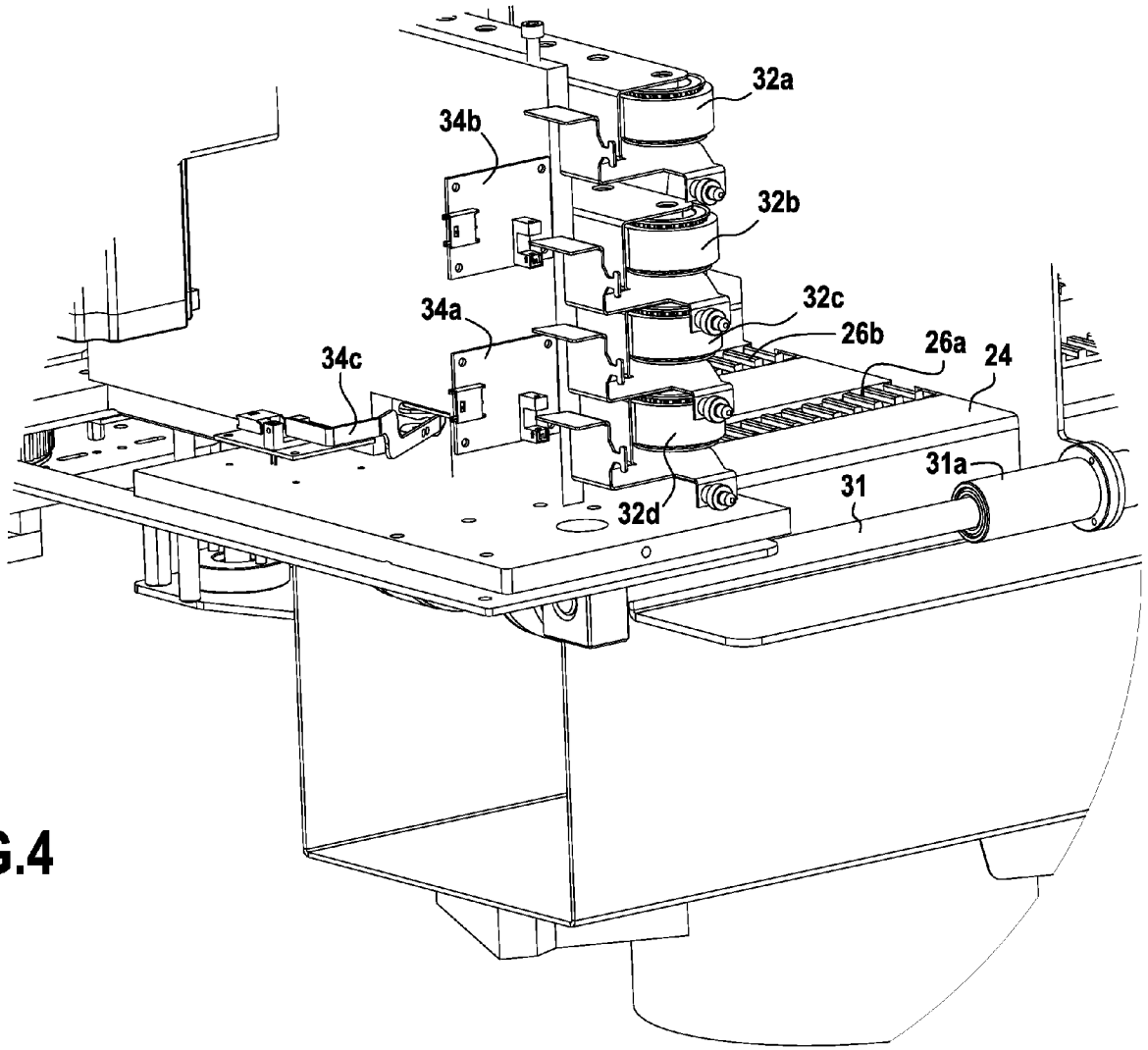
FIG. 4 is a partial perspective view corresponding to FIG. 3, showing the delivery and singulation belts.

As shown on FIG. 4, a plurality of optical sensors 34*a*, 34*b*, 34*c* is associated with the forwardly-driven series of transverse endless belts 32*a*-32*d* for detecting both the presence and the right presentation position of the coming envelope to be singulated. First and second sensors 34*a* and 34*b* inform on the right vertical presentation of the envelope with an angle tolerance range of a few degrees, e.g. 5 degrees. Third sensor 34*c* at the bottom informs on the end of the batch of envelopes.

Figure 5:
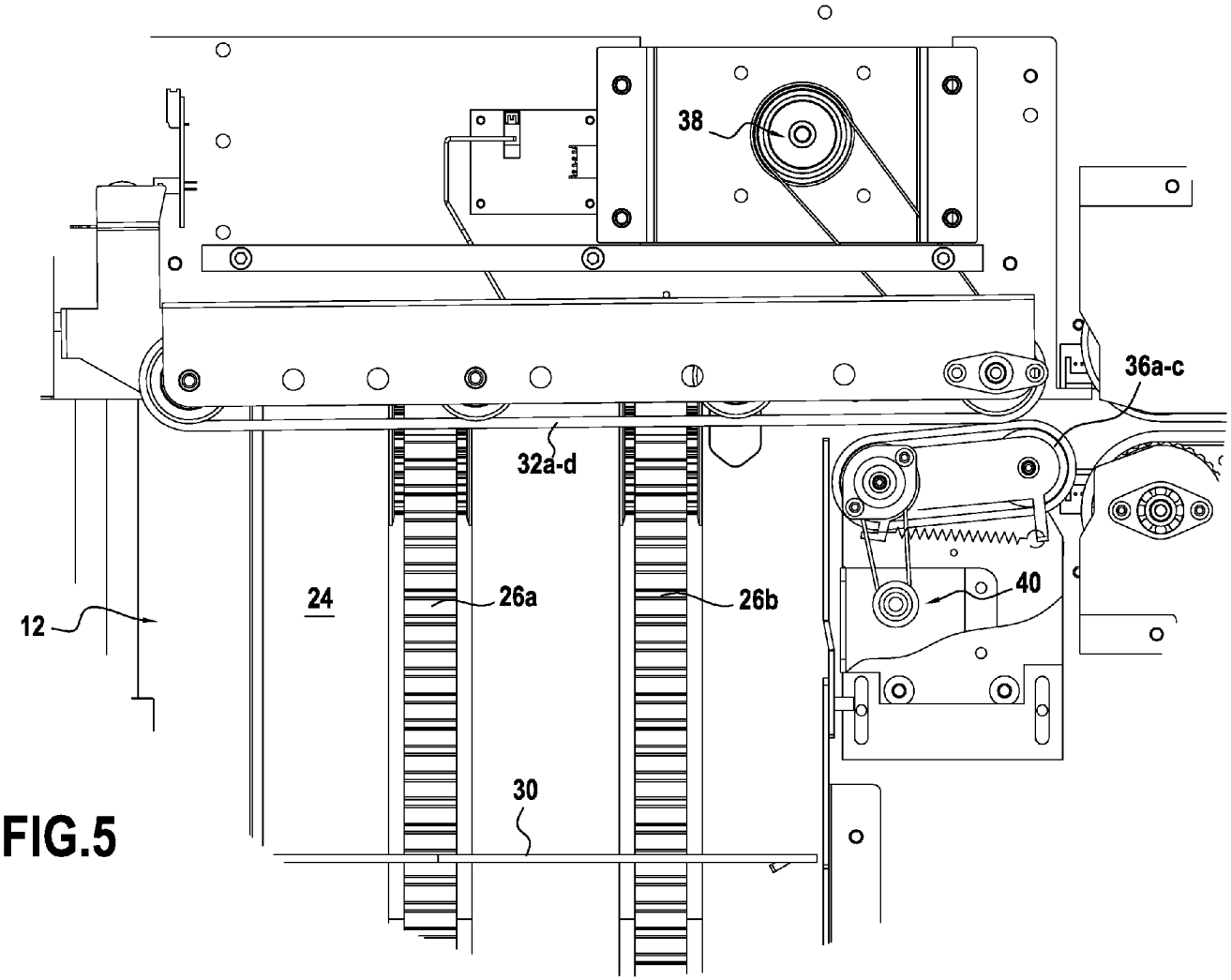
FIG. 5 is a partial top plan view corresponding to FIG. 2, showing the three series of belts of the delivery and singulation belts.

As shown on FIG. 5, the forwardly-driven spring-loaded series of transverse endless belts 32*a*-32*d* cooperate with a smaller series of endless belts 36*a*, 36*b*, 36*c* for singulating envelopes from the delivering section for further processing in the sorting machine. The four forwardly-driven spring-loaded transverse endless belts 32*a*-32*d* are driven by a stepper motor 38 whereas the three smaller singulating belts 36*a*, 36*b*, 36*c* are fixed. However, a dc gear motor 40 changes the cyclic position of these latter every n envelopes, e.g. 1 cm move every 20 envelopes, in order to limit belt wear.

The feeding apparatus described above operates as follows.

Delivering section 12 receives a large batch of envelopes loaded manually by an operator. The large batch is held straight on the transport deck 24 over the three conveying zones A, B, C between said paddle 30 and said forwardly-driven series of transverse endless belts 32*a*-32*d*. Thanks to the specific arrangement of the delivering path in these conveying zones, the pressure on the large stack is better distributed over the entire length of the batch for optimizing its singulation. Starting from first zone A, the envelopes rest on the transport deck 24, then on the toothed belts 26*a*, 26*b* in the second zone B and finally on the transport deck 24 again in the third zone C. The driving pulleys 27*a*, 27*b* and driven pulleys 29*a*, 29*b* located under deck 24 tension the toothed belts 26*a*, 26*b*. They maintain constantly both driven belts against the supporting plate 28.

As zone B spreads over more than half the thickness of the large batch of envelopes, friction forces of this batch on transport deck 24 are strongly reduced with the protruding toothed belts 26*a*, 26*b* which drive it actively in combination with paddle 30 for providing a reduced final pressure between said transverse belts and the envelope to be singulated. This pressure could effectively be much more important if the entire large batch has to be moved by only the paddle with the belts located under the transport deck, or by only the toothed belts located completely above the transport deck. In the latter case, the packed thin envelopes received in the last notch before being singulated are released together and are likely prone to multifeeding.

Combining the contact with both the transport deck and the toothed belts provides an original and simple solution for optimizing the delivery of a large batch to the singulating device. When the first envelopes leave the teeth of belts 26*a*, 26*b*, they are released and fall gently on the transport deck 24 while being pressed by the following envelopes still driven by these belts and this paddle. Envelopes which rested in the same notch between two teeth of the belts gradually loosen for getting an optimum presentation position to the singulating belts 32*a*-32*d* which are associated with the three optical sensors 34*a*, 34*b*, 34*c*, the status of which being as follows:

| Sensor status | Sensor 24a | Sensor 24b | Sensor 24c |
|---|---|---|---|
| Feeder empty | Open | Open | Close |
| Envelope with early pressure | Open | Open | Open |
| Envelope near correct position | Close | Open | Open |
| Envelope near correct position | Open | Close | Open |
| Envelope in feeding position | Close | Close | Open |
| Feeder empty (paddle on belts) | Close | Close | Close |

Of course, the operator usually continues to load the envelopes on the fly by pivoting and sliding the paddle while the sorting machine is running.

While the invention has been shown and described above with respect to a preferred embodiment, the foregoing and other changes in form and detail may be made therein by one skilled in the art while still remaining within the spirit and scope of the invention.

The invention claimed is:

1. Flat item feeding apparatus (10) having:

a delivering section (12) for receiving a batch of flat items stacked-on edge on a transport surface (24, 26*a*, 26*b*);

a singulating section (14) for extracting the items one by one and transferring them downstream;

said delivering section comprising:

a transport device (22) for conveying said stacked on edge flat items towards said singulating section, a pushing device (30) supported above said transport surface for jogging said stacked on edge flat items during said conveying toward the singulating section, said transport device further comprises:

at least one endless belt (26*a*, 26*b*) protruding a transport deck (24) within a determined conveying zone B of length d of said delivering section and separated a determined distance d2 from an axis of a downstream pulley (29*a*, 29*b*) and separated a determined distance d1 from an axis of an upstream pulley (27*a*, 27*b*), the distances d1 and d2 respectively defining determined conveying zone A, C in which said at least one endless belt remains below said transport deck, the apparatus being characterized in that a supporting plate (28) is disposed under the determined conveying zone B and in that the upstream pulley and the downstream pulley are both located under said transport deck, the axis of the upstream pulley and the axis of the downstream pulley at two different vertical levels for tensioning and maintaining said at least one endless belt against the supporting plate, wherein the supporting plate which defines the conveying zone B is entirely between the axis of the downstream pulley and the axis of the upstream pulley when looking at the top of the transport deck.

2. The apparatus of claim 1, wherein d equals at least d1+d2, d1 is around 10 cm and d2 is around 25 cm.

3. The apparatus of claim 1, wherein said at least one endless belt is a toothed belt (26*a*, 26*b*) in each notch of which can fit the thickest flat item.

4. The apparatus of claim 3, wherein said pushing device is a paddle (30) that can slide on a supporting shaft (31) of the delivering section around which it can also pivot via a handle (30*c*) and a rotating ring (31*a*) while being driven by the at least one endless belt via at least one lug (30*a*, 30*b*).

5. The apparatus of claim 1, wherein said singulating section comprises a forwardly-driven series of transverse endless belts (32*a*-32*d*).

6. The apparatus of claim 5, wherein a plurality of sensors (34*a*, 34*b*, 34*c*) is associated with said forwardly-driven series of transverse endless belts for detecting both the presence and the position of the flat item to be singulated.

7. The apparatus of claim 5, wherein said forwardly-driven series of transverse endless belts of the singulating section cooperate with a smaller series of endless belts (36*a*, 36*b*, 36*c*), the position of which is changed every n flat items, by a motor (40) for limiting belt wear.

8. The apparatus of claim 1, wherein said pushing device is removably mounted on said transport device which can drive said pushing device over the entire length of said batch of flat items.

9. The apparatus of claim 8, wherein the at least one lug of the paddle is received in a notch formed between two teeth of the at least one endless belt that drives the paddle, and presents a variable height for maintaining the coupling to said at least one belt over the entire thickness of said batch of envelopes.

10. The apparatus of claim 9, wherein this batch of flat items is held straight under a variable pressure between said paddle and said forwardly-driven series of transverse endless belts of the singulating section.

11. The apparatus of claim 1, wherein said flat items include mail pieces such as stuffed envelopes.

* * * * *